US008367985B2

(12) United States Patent
Lollar

(10) Patent No.: US 8,367,985 B2
(45) Date of Patent: Feb. 5, 2013

(54) MICA BOARD ELECTRIC RESISTANCE WIRE HEATER AND METHOD OF USE

(75) Inventor: James Patrick Lollar, Baxter, TN (US)

(73) Assignee: Tutco, Inc., Cookeville, TN (US)

( * ) Notice: Subject to any disclaimer, the term of this patent is extended or adjusted under 35 U.S.C. 154(b) by 469 days.

(21) Appl. No.: 12/763,460

(22) Filed: Apr. 20, 2010

(65) Prior Publication Data

US 2010/0270287 A1 Oct. 28, 2010

Related U.S. Application Data

(60) Provisional application No. 61/202,953, filed on Apr. 22, 2009.

(51) Int. Cl.
*H05B 3/06* (2006.01)

(52) U.S. Cl. ..... 219/536; 219/542; 219/532

(58) Field of Classification Search ..... 219/532–552
See application file for complete search history.

(56) References Cited

U.S. PATENT DOCUMENTS

| | | | | |
|---|---|---|---|---|
| 3,912,903 | A * | 10/1975 | Northrup et al. | 219/532 |
| 6,884,974 | B2 | 4/2005 | Howard et al. | |
| 7,764,873 | B2 * | 7/2010 | Panaghe | 219/543 |
| 2004/0182853 | A1 * | 9/2004 | Howard et al. | 219/536 |

* cited by examiner

*Primary Examiner* — Cuong Q Nguyen
(74) *Attorney, Agent, or Firm* — Clark & Brody

(57) ABSTRACT

A mica board heater has a mica board support plate assembly that isolates the mica boards from the frame of the heater. The mica board support plate assembly includes a mica board with openings sized to receive ends of the mica boards that support the resistance wires. The mica board with the specially sized openings is supported by a frame that is attached to the heater frame. By using the mica board support plate assembly, the mica boards are electrically isolated from the frame and without compromising the structural soundness of the frame.

5 Claims, 6 Drawing Sheets

MICA BOARD ELECTRIC RESISTANCE WIRE HEATER AND METHOD OF USE

This application claims priority under 35 U.S.C §119(e) based on application Ser. No. 61/202,953 filed on Apr. 22, 2009.

FIELD OF THE INVENTION

The present invention is directed to a mica board electric resistance wire heater and, in particular to a heater that electrically isolates the mica boards from the heater frame without compromising the structural soundness of the frame.

BACKGROUND ART

In the prior art, mica board electric resistance wire heaters (mica board heaters) are well known. U.S. Pat. No. 6,884,974 to Howard et al. is one example of these types of heaters. This patent is incorporated in its entirety by reference. The mica board heater typically has a number of mica boards that are supported by a metal frame. The frame can be square or rectangular in shape and can be made of up elongated frame members that are attached to each other. The mica boards that support the resistance wires extend between two sides of the frame and are generally supported by the frame's elongated members, which are generally in the form of plates.

Heaters in the prior art in one case do not address the problem associated with unacceptable levels of current leakage resulting from moisture adsorption between the layers making up mica support boards. In the second case of the prior art, which addresses the problem of current leakage, the methods taught create a weakened support structure for the heater assembly itself.

The problem is that current leakage occurs between the live metallic heating element wire and ground (or earth) by traveling from this wire along the moist mica to the heater frame and eventually to the metallic frame of the unit using the heater, e.g., an air conditioning unit itself. This phenomenon occurs especially during the cooling season when a unit's cooling A/C coils create moist conditions and the heater is de-energized. Even when switched off, the heater element is electrically alive relative to ground as only one side of the electric circuit is broken to de-energize the element. Leakage current flow may be high enough to create corrosive conditions in the heater wire thus shortening the heater life.

In those prior art heaters that address the problem noted above, each metallic side support member that holds mica pieces in place are riveted to a mica plate that is in turn riveted to the metallic heater assembly main support frame. The resultant effect is that the integrity of the heater depends upon relatively strong metallic members being retained in place by weaker mica material. Consequently, the structural integrity of the heater is compromised.

The type of heater designed to overcome the current leakage problem is shown in FIG. 1, wherein a mica board heater 10 is shown with mica boards 1, resistance wires 3, one frame member 5, and a second frame member 7. The frame members 5 and 7 are separated by a mica board 9, so that the frame 5 is attached, e.g., by riveting, to the mica board 9 and the mica board 9 is attached, e.g., by riveting, to the frame member 7. In this way, the frame member 5 that supports the end of the mica boards carrying the resistance wires is isolated to minimize the problem of current leakage.

The problem with the FIG. 1 assembly is that the mica board 9 becomes a structural part of the frame. Since mica board is inherently weak and clearly weaker than a metal frame, this frame construction can cause problems. That is, if the mica board 9 were to break, the frame attachment between members 5 and 7 would be compromised and the heater could collapse or short out.

Thus, there is a need to improve mica board heaters such that current leakage is minimized but without compromising the frame structural stability.

The present invention solves this need by providing a mica board heater that isolates the mica boards but without compromising the structural soundness of the frame.

SUMMARY OF THE INVENTION

In satisfaction of the objects and advantages of the invention, an improved mica board electric resistance heating wire heater is provided. The heater comprises a frame and a plurality of mica boards, with each mica board supporting an electric resistance heating wire. Each of the mica boards has first and second opposing ends with each of the first and second opposing ends supported by the frame. The heater also includes first and second mica board support plates. Each of first mica board support plate supports a respective first end of the mica boards with the second mica board support plate supporting the other respective ends of the mica board. This configuration isolates the first and second opposing ends of the mica boards from the frame.

The heater also includes first and second mica board support plate holders. The holders are adapted to hold the first and second mica board support plates. The first and second mica board support plate holders can be either part of the frame or an additional support structure with the frame.

The first and second mica board support plates can have openings for receiving and supporting the first and second opposing ends of the mica boards. Each of the first and second mica board support plate holders can further comprise either a pair of elongated support members being adapted to hold the mica board support plate in position by supporting the first or second opposing ends of the mica board or a plate member being adapted to hold the mica board support plate in position to support the first or second opposing ends of the mica board. The pair of elongated support members or plate member can be part of the frame.

The frame can also comprise first opposing frame members and second opposing frame members. Each of the first opposing frame members can have at least one frame opening therein to receive the opposing ends of the mica boards. The first and second opposing frame members when attached together form the frame, wherein the first opposing frame members also support the first and second mica support plates. Each of the first and second mica support plates has openings aligned with the at least one frame opening to receive and support the opposing ends of the mica boards without the opposing ends contacting the first opposing frame members.

The invention also is an improvement in the method of heating using a mica board heater, wherein the improvement results in using the heater having the inventive features of the mica board support plates and plate holders described above.

DETAILED DESCRIPTION OF THE PREFERRED EMBODIMENTS

The invention offers significant advantages in the field of mica board heaters. By practicing the invention, the problem of current leakage is minimized in mica board heaters while at the same time the soundness of the heater frame is maintained. This is done by not using mica board in constructing the frame support structure, but still using it for electrical isolation.

The invention is intended to present a unique method which may be used to combat or lower current leakage arising from dust, debris, moisture or any other means by which current may pass from the heating wire to ground. This method and invention is unique in that it allows the entire heating assembly to remain rigid while adding the means to further insulate the heating wire from current leakage to ground. In order to accomplish this, the main heater assembly metal structure remains intact while some metal material is removed or its shape is modified without removal of the strengthening characteristics of the frame. The metal that is removed is replaced with an isolative material which is used as a means to support the heater assembly element banks. The isolative material is further mounted in a manner which isolates the machined edge of the mica board material from contact with dust and debris as mentioned above. The overall impact of the invention is to further combat, insulate, and isolate leakage of current from the heater element wire to ground while maintaining a rigid structure for the entire heater assembly.

In one mode, the invention entails matched pairs of mica boards that have heater resistance wire coiled around them. Mica board support plates retain opposite ends of each mica board. The mica board support plate holders made of metal in turn retain the mica support plates. The metallic mica board support plate holders are designed such that ends of the mica boards are neither in contact with the metal mica board support plate holders nor are in close proximity to any metallic material. This creates sufficiently long over surface paths and resultant high resistance to current flow that leakage current is minimized or eliminated, and this results in little or no corrosion of the heater element wire.

Figure 1:
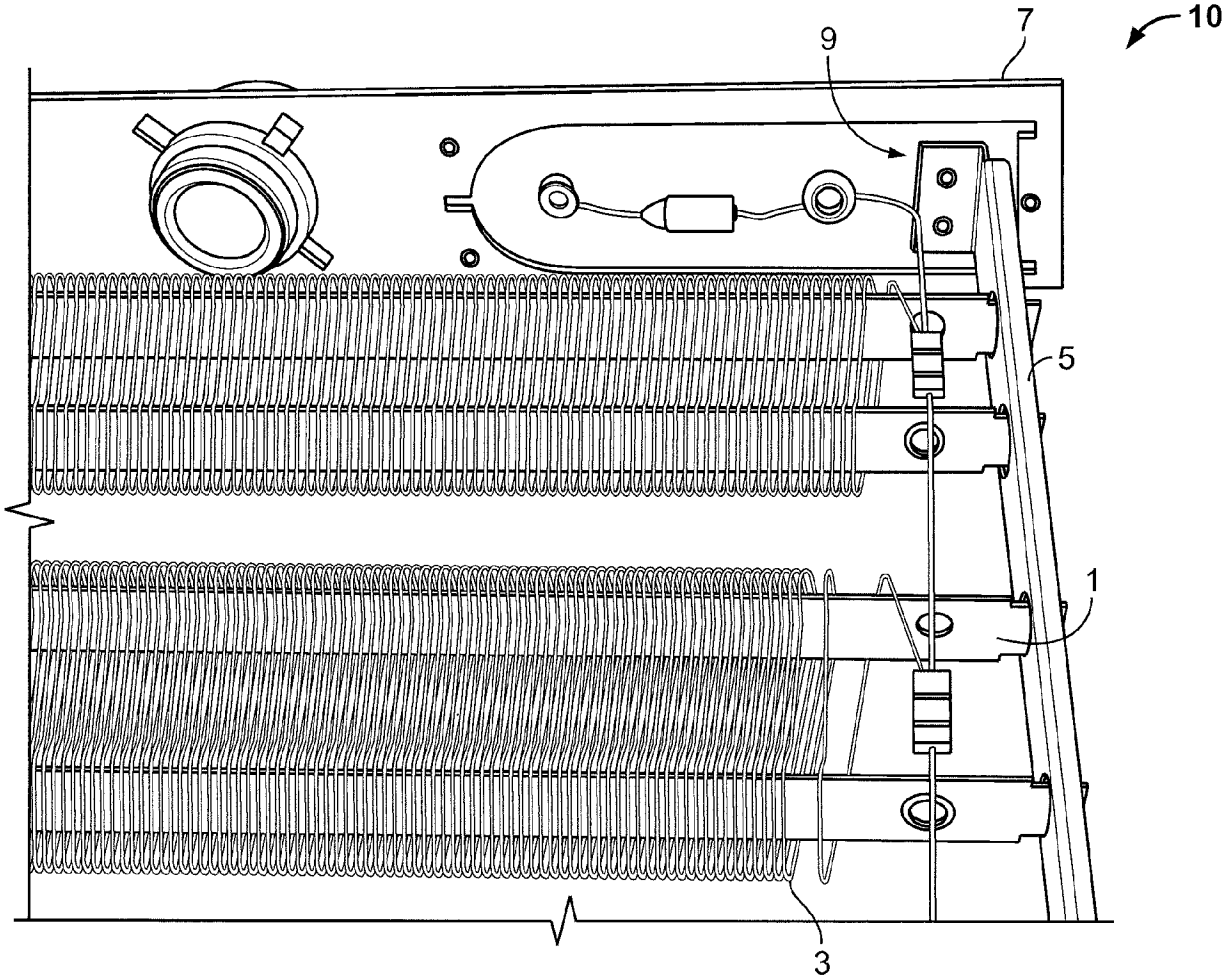
FIG. 1 (Prior Art)
FIG. 1 shows a perspective view of a prior art mica board heater with the mica board situated between frame components.
Figure 2:
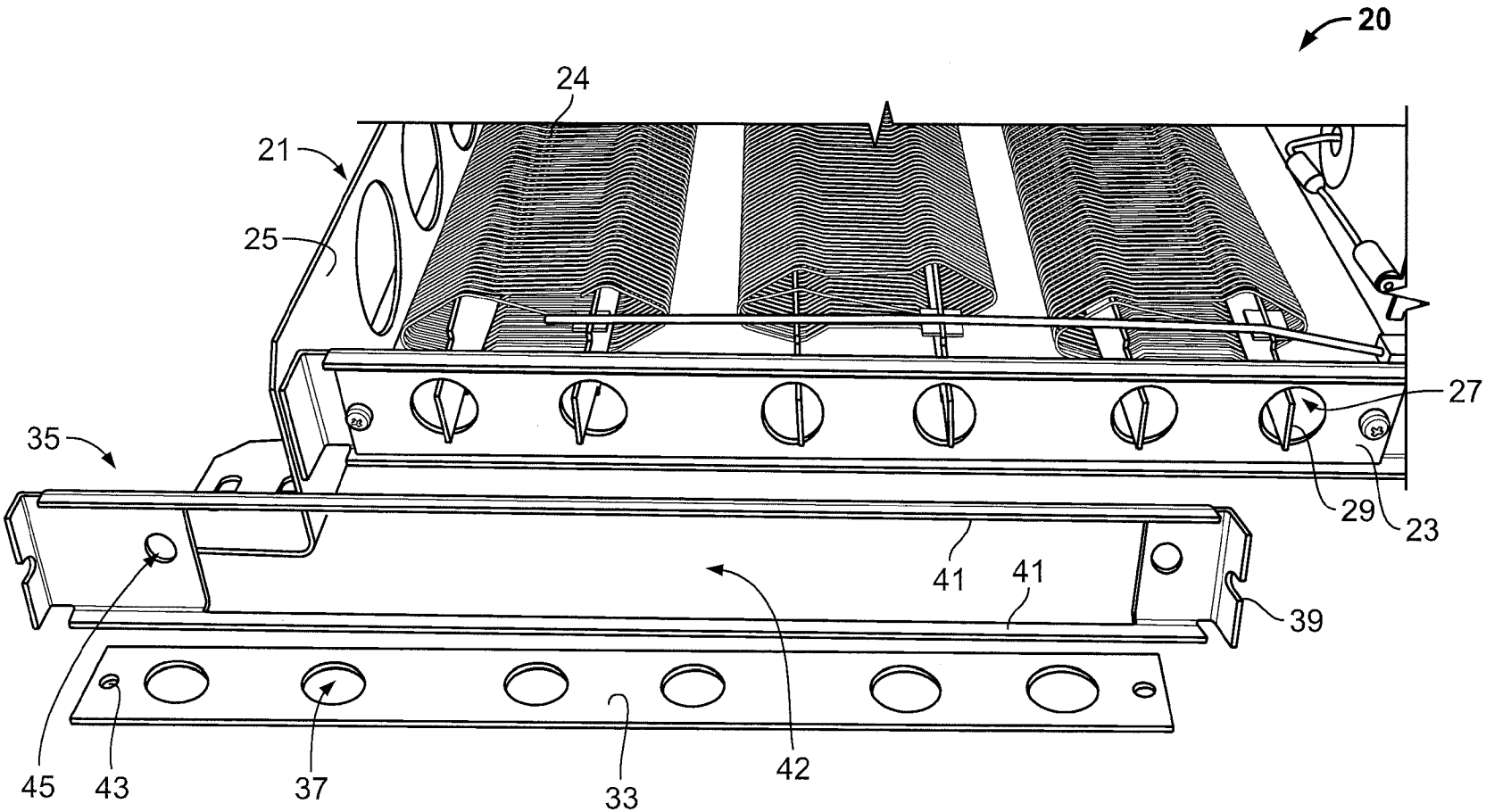
FIG. 2 shows a partial perspective view of one embodiment of a mica board heater according to the invention.

FIG. 2 shows a partial view of a mica board heater according to one embodiment of the invention. The heater 20 has a frame 21, with a first set of opposing frame members 23 (one shown) and a second set of opposing frame members 25 (one shown). The frame members 23 are designed to support ends 29 of the mica boards 31 (see FIGS. 3A and 3B), which support the electrical resistance wires 24. The heater in an assembled state is shown in the background of FIG. 2, and a disassembled mica board support plate assembly is shown in the foreground.

The mica board support plate assembly includes a mica board support plate 33 that is designed to support the ends 29 of the mica boards 31. The mica board support plate 33 is supported by the frame member 23, which is modified from the normal frame members used in a mica board heater as described below.

Figure 3A:
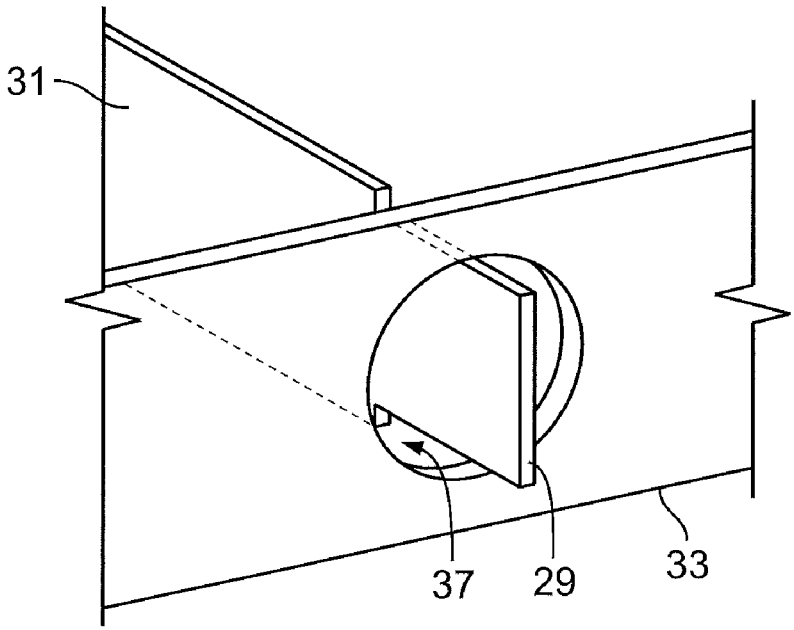
FIGS. 3A and 3B are details of the feature of the heater of FIG. 2.

The mica board support plate 33 has a number of openings 37, which are sized to receive the ends 29 of the mica boards 31, see FIG. 3A as it relates to FIG. 2. The openings 37 and frame member 23 are designed in size so that the ends 29 of the mica boards 31 do not contact the frame member 23. This means that the ends 29 rest only on the mica board support plate 33 and not any portion of the frame member 23, thus isolating the mica boards 31 from the frame. The detail of the heater in FIG. 2 as shown in FIG. 3B shows more clearly how the mica boards 31 interface with the mica board support plate 33.

Figure 3B:
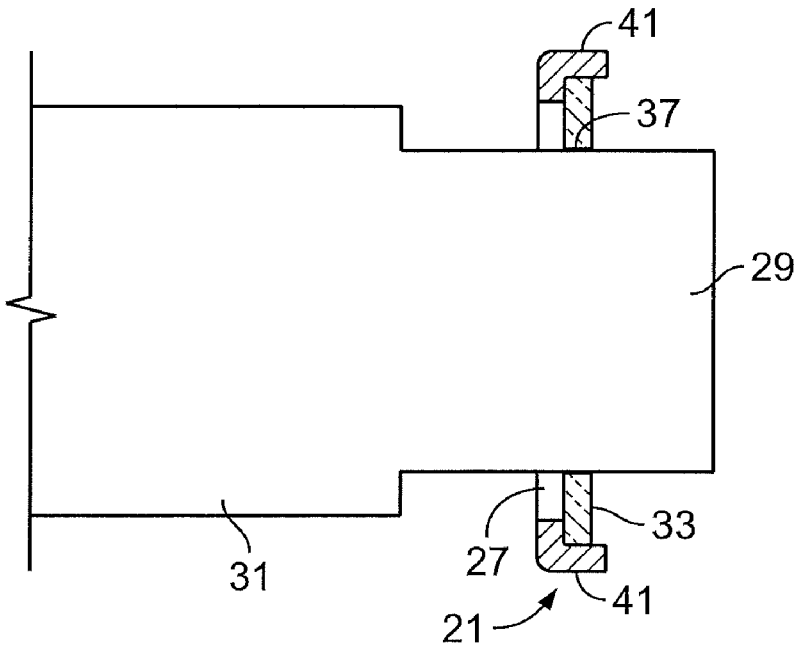

In the foreground of FIG. 2 and FIG. 3B, the frame member 23 of the support assembly is made with a pair of flanges 39 on opposing ends (one shown) and two l-shaped members 41 positioned between the flanges 39. The mica board sits against the l-shaped members 41 and is attached using fasteners, e.g., screws, rivets, etc., using holes 43 in the mica board, and holes 45 in the flanges 39. The l-shaped members create an elongated frame opening 42 that allows the ends 29 of the mica board 31 to pass through the frame member 23 without contacting it and be supported solely by the mica board support plate 33. The l-shaped members are spaced apart so that a gap 28 exists between the end 29 of the mica board and the l-shaped member 41 so as to minimize or eliminate current leakage.

It should be understood that any other type of frame configuration or means can be employed for supporting the mica board 33 so that it can hold the ends of the mica boards 31 of the heater. For example, the members 41 could have vertical supports running along the length of the members 41 for further structural rigidity for the frame member 23.

A plate with the appropriate sized openings could be used in substitution of the two members 41. In this plate embodiment, the openings in the plate would be larger than the openings in the mica board support plate 33 to ensure that the ends 29 of the mica board only contacts the support plate 33, not the frame 23.

While a pair of flanges are shown as part of the support plate assembly, other configurations as would be known in the art can be employed, e.g., the members 41 could terminate in a plate on one or both ends, with the plate being spot welded to the frame members 25. The members 41 could also be flat rather than l-shaped when receiving the mica board support plate 33.

Figure 4A:
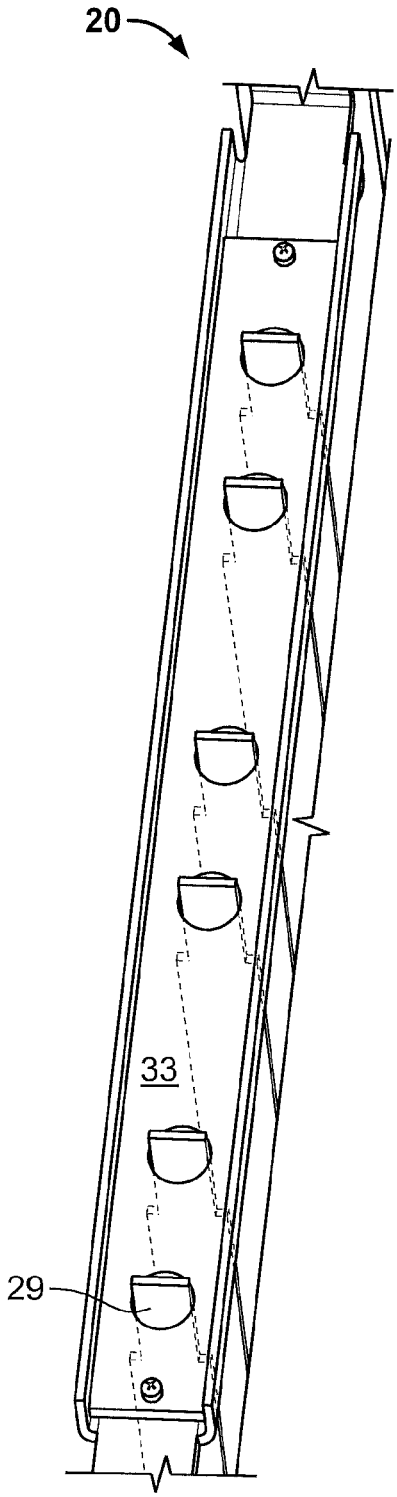
FIG. 4A show a heater frame member according to the invention.
Figure 4B:
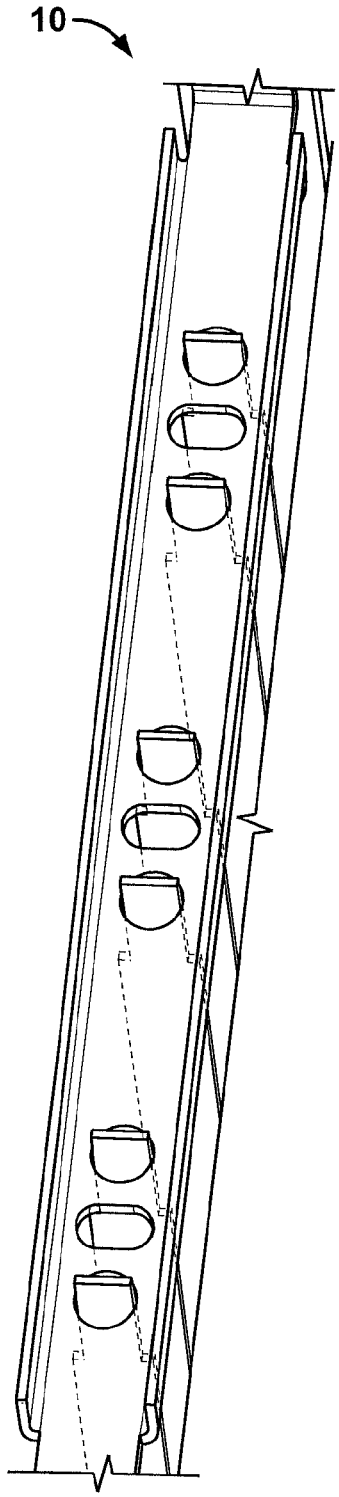
FIG. 4B (Prior Art)
FIG. 4B shows a prior art heater frame member.

FIG. 4A shown a side view of the inventive heater 20 next to a prior art heater 10 shown in FIG. 4B. The mica board 33 is shown with the ends 29 of the mica boards 31 protruding outwardly for heater 20.

Figure 5:
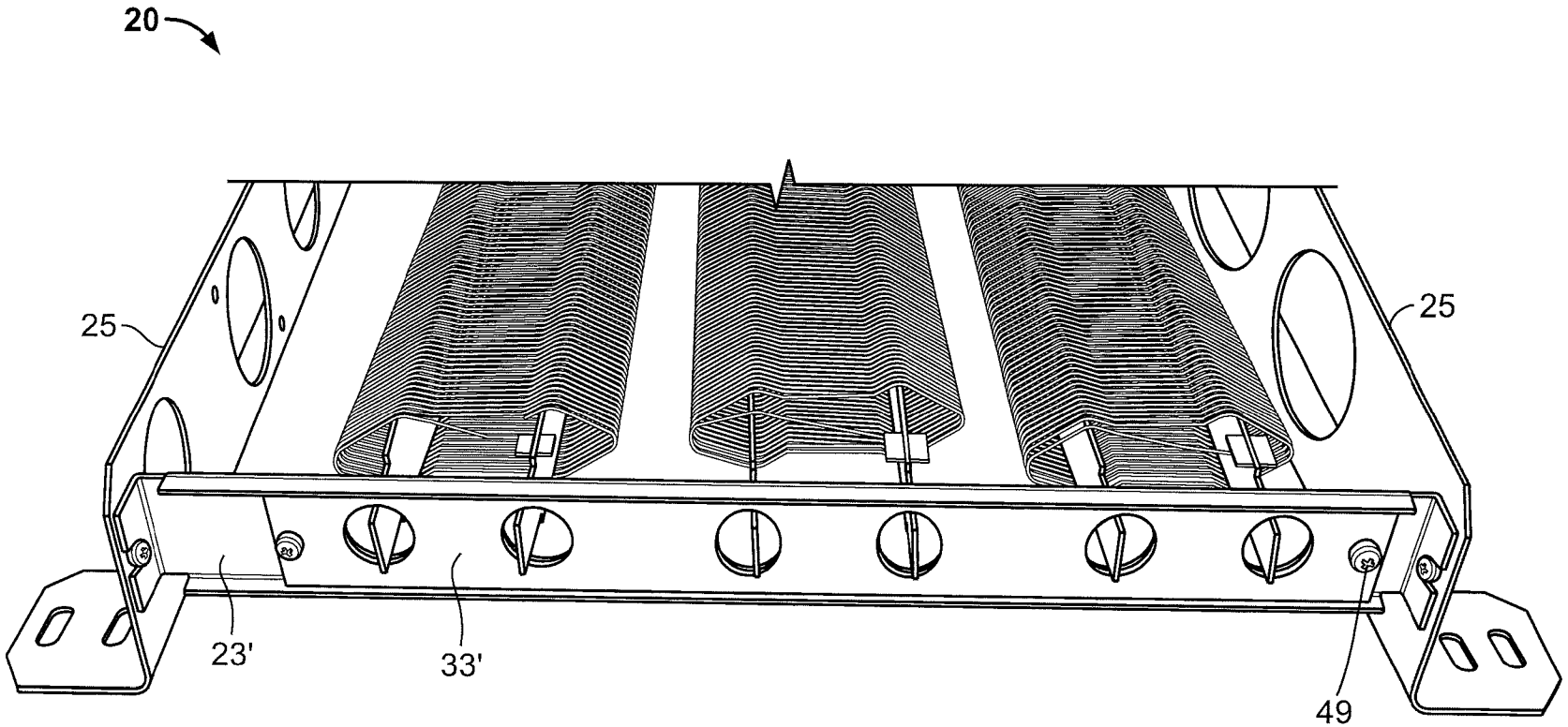
FIG. 5 shows another embodiment of the mica board heater.
Figure 6A:
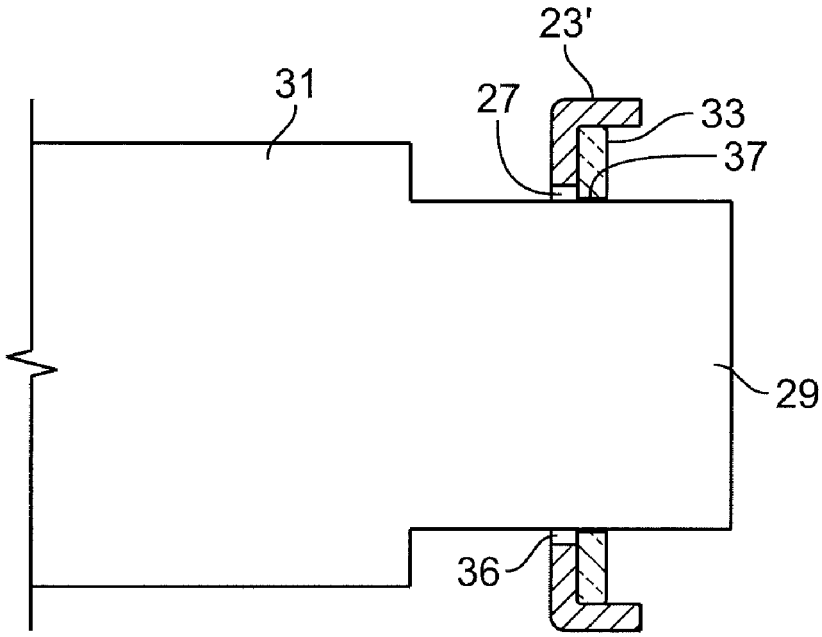
FIGS. 6A and 6B show details of the heater of FIG. 5.

FIG. 5 shows another embodiment of the invention. In this embodiment, the frame member 23 of the previous embodiment is plate-like rather than the rod-like member shown in FIG. 2 to hold the mica board support plate 33. With particular attention to the detail shown in FIG. 6A, the frame member 23' has openings 27 and the mica board support plate 33 has corresponding openings 37. The openings 27 are sized so that there is a clearance 36 surrounding the edge of the end 29 of the mica board to avoid contact with the frame member 23'. The opening 37 is sized so that the edge of the end 29 rests on the mica board support plate 33. This provides the isolation between the frame 23' and the mica boards 31 while still providing an integral frame construction since frame member 23' is still linked to the other opposing frame members 25. In FIG. 5, flanges are used to link the frame member 23' but any means of attachment of the frame member 23' can be employed to link to the other frame members 25. FIG. 5 also shows that the mica board 33 is attached to the frame member 23 using fasteners 49. Of course, any means of attaching the mica board support plate 33 to the other frame members 23' can be employed in this embodiment.

Figure 6B:
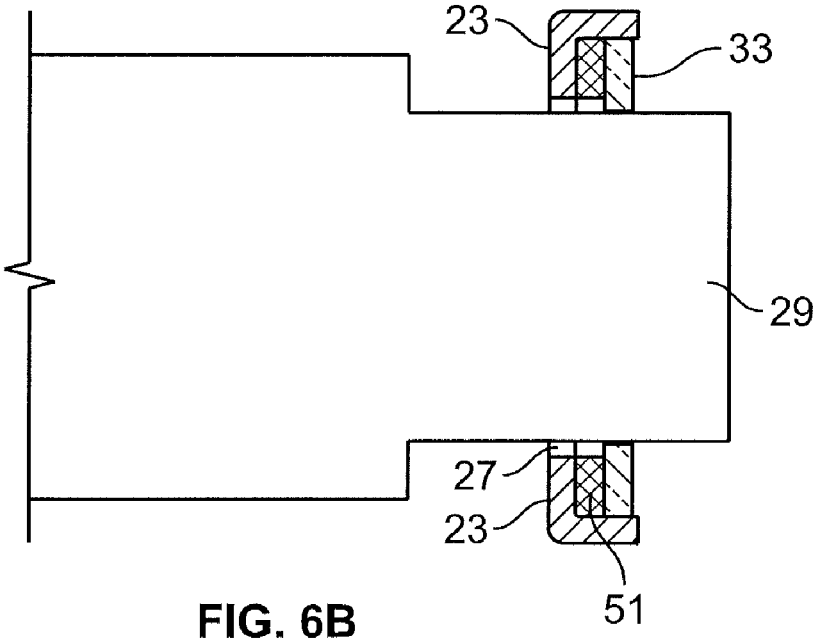

Referring to the detail shown in FIG. 6B, the mica board support plate 33 could have its own support structure, designated as 51 to support it independently of the frame member 23. This support structure could be attached to the frame member 25 or the frame member 23.

While the mica board heater is shown with a particular design of a metal frame with four sides and two sets of opposing frame members that are linked together, the concept of isolating the ends of the mica boards from a frame member could be used in other applications that did not involve the frame design as illustrated. For example, only two frame members could be used to support the mica boards and these frame members could be mounted to a structure other than other frame members. While the illustrated heaters have a frame made of metal members, the two mica board supporting frame members 23 could be mounted to structure other than the specific frame members 25. Here, the mica board support plate 33 could still be employed to isolate the mica boards 31 from the frame members 23 or 23' that provide at least some of the structural support for the heater. For purposes of this application, the frame of the heater is considered the frame members 23 or 23' and their supporting structure, whether it be other frame members or some other support which supports the members 23 or 23'.

As such, an invention has been disclosed in terms of preferred embodiments thereof which fulfills each and every one of the objects of the present invention as set forth above and provides a new and improved mica board heater and method of use. Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. In a mica board electric resistance heating wire heater comprising a frame, a plurality of mica boards, with each mica board supporting electric resistance heating wire, each of the mica boards having first and second opposing ends, each of the first and second opposing ends supported by the frame, the improvement comprising:

first and second mica board support plates, the first mica board support plate supporting the first opposing ends of the mica boards and the second mica board support plate supporting the second opposing ends of the mica board so that the first and second opposing ends of the mica boards are isolated from the frame, and a first mica board support plate holder adapted to hold the first mica board support plate and a second mica board support plate holder adapted to hold the second mica board support plate, the first and second mica board support plate holders being either part of the frame or an additional support structure with the frame.

2. The heater of claim 1, wherein the first and second mica board support plates have openings for receiving and supporting the first and second opposing ends of the mica boards.

3. The heater of claim 1, wherein each of the first and second mica board support plate holders further comprise:

a pair of elongated support members being adapted to hold the mica board support plate in position to support the first or second opposing ends of the mica board or a plate member being adapted to hold the mica board support plate in position to support the first or second opposing ends of the mica board, the pair of elongated support members or plate member being part of the frame.

4. The heater of claim 1, wherein the frame comprises first opposing frame members and second opposing frame members, the first opposing frame members having at least one frame opening therein to receive the opposing ends of the mica boards, the first and second opposing frame members attached together to form the frame, wherein the first opposing frame members also support the first and second mica support plates, each of the first and second mica support plates having openings aligned with the at least one frame opening to receive and support the opposing ends of the mica boards without the opposing ends contacting the first opposing frame members.

5. In a method of heating using a mica board heater, the improvement comprising using the heater of claim 1.

* * * * *